US006463962B2

(12) United States Patent
Dewispelaere

(10) Patent No.: US 6,463,962 B2
(45) Date of Patent: Oct. 15, 2002

(54) DEVICE FOR GUIDING THE KNIFE-SUPPORTING BEAMS IN A JACQUARD MACHINE

(75) Inventor: André Dewispelaere, Kortrijk/Marke (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 0 days.

(21) Appl. No.: 09/882,022

(22) Filed: Jun. 18, 2001

(65) Prior Publication Data

US 2002/0036022 A1 Mar. 28, 2002

(30) Foreign Application Priority Data

Jun. 16, 2000 (BE) ..... 2000/0388

(51) Int. Cl.[7] ..... D03C 3/36; D03C 3/06
(52) U.S. Cl. ..... 139/65
(58) Field of Search ..... 139/65, 62, 59

(56) References Cited

U.S. PATENT DOCUMENTS 4,465,107 A * 8/1984 Epis ..... 139/66 R
4,532,963 A * 8/1985 Bastion et al. ..... 139/455
5,115,838 A 5/1992 Derudder
5,176,181 A * 1/1993 Bassi ..... 139/1 E
5,513,676 A * 5/1996 Speich ..... 139/59
5,538,046 A * 7/1996 Bassi et al. ..... 139/59
5,927,347 A 7/1999 Palau et al.

FOREIGN PATENT DOCUMENTS

| | | |
|---|---|---|
| EP | 0 409139 | 1/1991 |
| EP | 0 849 384 | 12/1997 |
| WO | WO 97/08372 | 3/1997 |

* cited by examiner

*Primary Examiner*—Andy Falk
(74) *Attorney, Agent, or Firm*—James Creighton Wray; Meera P. Narasimhan

(57) ABSTRACT

A device for guiding the knife-supporting beams in a jacquard machine is provided. The device is for rectilinear guiding of a body (1) of a shed-forming device that can be driven in a back and forth movement. The device has a rod mechanism (2, 3, 4) of which a first (2) and a second rod (3) are rotatably connected to respectively the aforesaid body (1) and a fixed part (11). This rod mechanism is provided to exert a rectilinear movement on the joint (5) between the body (1) and the first rod (2) while driving the body (1). The joint (5) between the first rod (2) and the body (1) moves for that purpose preferably in a straight line through the joint (7) between the second rod (3) and the fixed part (11). This device is especially utilized as a shed-forming device of a machine of the Jacquard type for the rectilinear guiding of knife-supporting beams. Such a rectilinear guide has the advantage that it can be implemented with only hinge points that require no maintenance.

13 Claims, 2 Drawing Sheets

DEVICE FOR GUIDING THE KNIFE-SUPPORTING BEAMS IN A JACQUARD MACHINE

This invention relates to a device for the rectilinear guiding of a body of a shed-forming device that can be driven in a go and fro movement.

In the Belgian patent publication no. 1 004 308 a drive system for the knife-supporting beams of a Jacquard machine is described whereby the knife-supporting beams perform a vertical up and down movement through driving of two follower levers located diametrically opposite each other via two complementary cam disks that are on both extremities of a central drive shaft. In order to prevent the knife-supporting beams from lateral oscillation during the up and down vertical movement, on both extremities of the knife-supporting beams a guide is provided that can be implemented as a roller set, sliding set or ball bushings on guide rods. The disadvantage of this type of guide is that this has to be abundantly lubricated and requires rather a lot of maintenance, which with textile machines is considered as a disadvantage. This guide is furthermore not very suitable for the operation of Jacquard machines with high speed.

In the European patent application no. 0 849 384 a drive system for the knife-supporting beams is described whereby the guiding in longitudinal direction of the knife-supporting beams is implemented by oscillating levers, which are secured to rods, which in their turn are connected via small connecting rods to a second series of levers. The aforesaid levers are on the extremity of a fixed tube in which there are two coaxially placed longitudinal shafts which perform an alternate rotary movement, whereby the aforesaid rotary movement is generated by transmission from the rotary movement of a drive shaft on the coaxially placed longitudinal shafts via a cam mechanism. The disadvantage of this device is that the pivoting point of the oscillating levers in the knife-supporting beam does not describe a straight line but an arc around a fixed pivot. Because of this during their up and down movement the knife-supporting beams undergo a small lateral movement perpendicular to the vertical movement. The lateral movement is then also transmitted to the knife supports through which the lifting knives experience more friction in the guide. The circular arc movement also gives rise to centrifugal forces through which the device is subjected to vibrations at high operating speed.

The purpose of the invention is to provide a device for the rectilinear guiding of a body of a shed-forming device that can be driven in a go and fro movement by which the above mentioned disadvantages are remedied.

This purpose is achieved by providing a device such as has been described in the first paragraph of this specification, but whereby the device comprises a rod mechanism of which a first and a second rod are rotatably connected to respectively the body and a fixed part, and whereby this rod mechanism is provided in order to exert a rectilinear movement on the joint between the body and the rod during the movement of the driven body. The advantage of this device is that the knife support beams will no longer perform any lateral movement and then also no centrifugal forces will occur. This device will cause less vibrations in the knife support beams and furthermore operate at higher operating speeds and will require no maintenance.

According to a particular embodiment of the device the joint between the first rod and the body can move in a straight line through the joint between the second rod and the fixed part.

In a preferred embodiment the first and the second rod are rotatably connected to each other, and the rod mechanism is so constructed that the joint between the second rod and the fixed part form the three angular points of an isosceles triangle and the first and the second rod always form a same angle in relation to the plane perpendicular to the direction of movement.

A significant characteristic of the invention is that the first rod is rotatably connected in a first joint on this first rod to the aforesaid body, the second rod is rotatably connected in a first joint on this second rod to the fixed part and the aforesaid first and second rod are rotatably connected to each other in a common second joint so that the distance between the first joints of the first and the second rod and the second joint for both rods is equal, and that means are provided to determine the positions of the rods in the course of the movement of the body so that the angle between the first rod and a plane perpendicular to the direction of movement is always equal to the angle between the second rod and a plane perpendicular to the direction of movement.

According to a preferred embodiment the first rod extends to past the common joint of the first and the second rod, and this is so guided that a point of the first rod located past the aforesaid common joint can move according to an almost horizontal movement path.

It is furthermore also preferred that the aforesaid point of the first rod and the aforesaid joint between the second rod and the fixed part lie in a same plane extending almost perpendicular to the direction of movement.

According to a preferred embodiment of the invention the first rod is rotatably connected past the joint to a third rod, which is rotatable in relation to a fixed point. The advantage of a hinge point as opposed to a point that has to perform a sliding movement, is that the aforesaid rotatable joint can be implemented with ball bearings that are sealed and are lubricated for life, so that these require no maintenance at all.

The rod mechanism preferably comprises only hinge points. This offers the same advantage as discussed in the preceding paragraph.

In a preferred embodiment of the invention the go and fro movement that is performed by the device is preferably an almost vertical movement.

In a preferred embodiment of the invention the aforesaid shed-forming device is a device of a machine of the Jacquard type.

In a preferred embodiment the aforesaid body is a knife-supporting beam.

This invention also relates to a drive system for knife-supporting beams (e.g. of a Jacquard machine) that is provided with a guiding device according to this invention.

This invention is preferably utilized by providing a Jacquard machine that is provided with at least one knife-supporting beam working together with a guiding device according to this invention.

In order to explain the properties of this invention further and in order to specify additional advantages and distinctive features thereof, there now follows a more detailed specification on the basis of the attached figures whereby:

Figure 1:
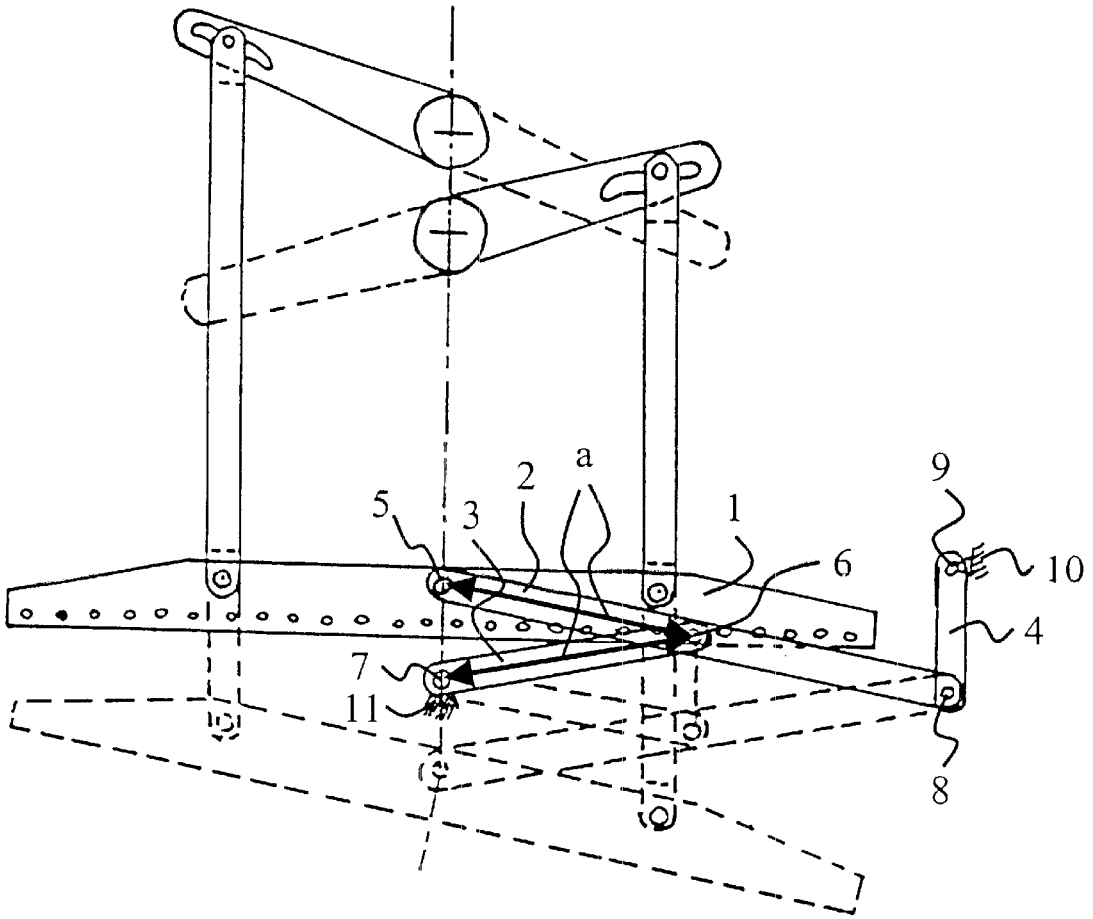
FIG. 1 is a schematic representation of a device for guiding the knife-supporting beams in a Jacquard machine in front view.
Figure 2:
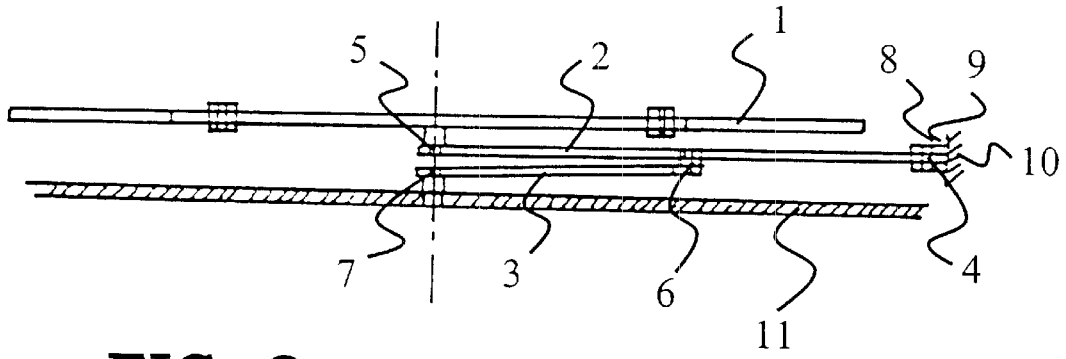
FIG. 2 is a schematic representation of the aforesaid device in top view.

As is shown in FIG. 1 and 2, a rod mechanism is provided that exerts a rectilinear movement on a specific point of the knife-supporting beam 1. At the aforesaid specific point a pivoting point 5 is attached between the knife-supporting beam and a first rod 2. At this pivoting point 5 the aforesaid first rod 2 is rotatably connected to the knife-supporting beam 1.

On the aforesaid first rod 2 at a distance a from pivoting point 5 a common pivoting point 6 of the first rod 2 and a second rod 3 is attached, through which this second rod 3 is rotatably connected to the first rod 2. The aforesaid second rod 3 is in turn rotatably connected via a pivoting point 7 to the frame of the Jacquard machine 11.

The first rod 2 extends in a straight line past the aforesaid common pivoting point 6 to a pivoting point 8 that provides a rotatable connection between the extending part of the first rod 2 and a third rod 4, which in turn is rotatably connected on pivoting point 9 to the frame 10. The aforesaid pivoting point 8 lies in a straight line through the pivoting point 7 that is perpendicular to the direction of movement.

Figure 3:
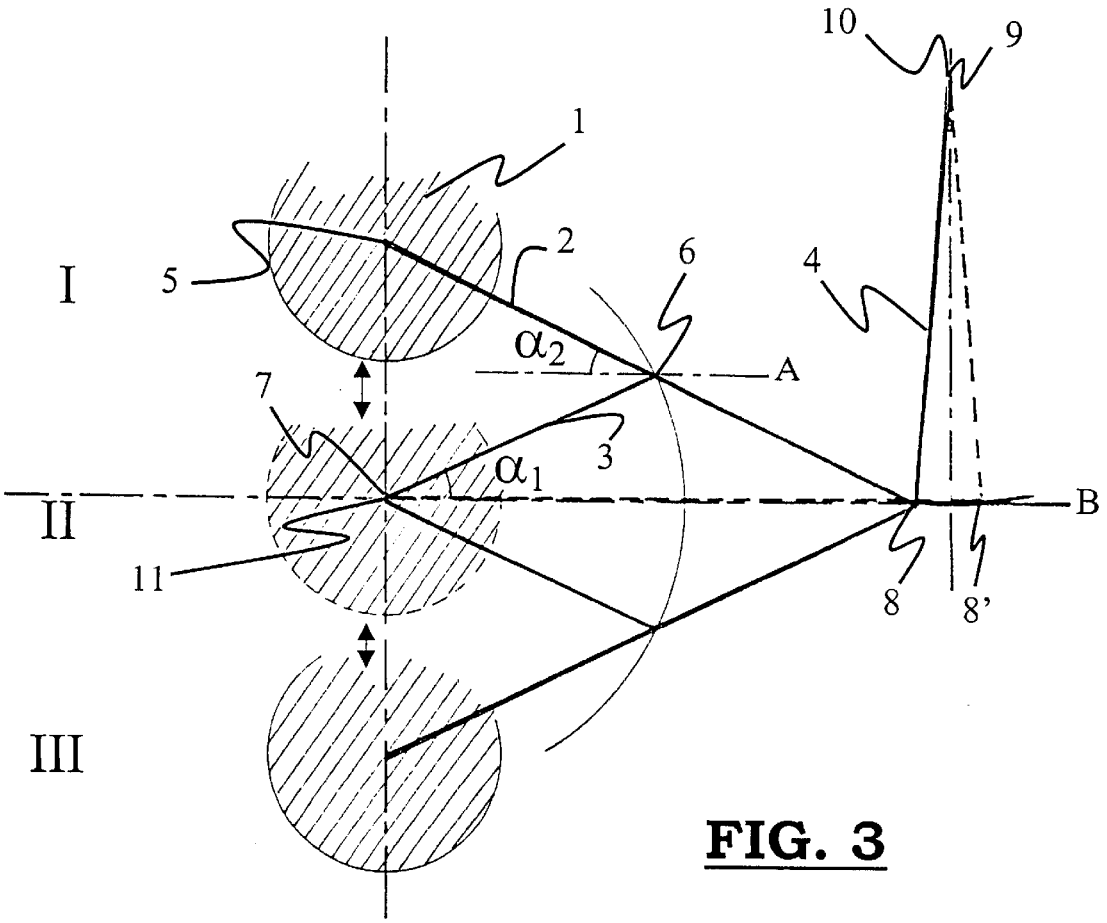
FIG. 3 is a schematic representation of three positions of movement of the aforesaid device.

As can be seen in FIG. 3 the pivoting point 5 between the knife-supporting beam 1 and the first rod 2 will move according to a straight line during the vertical up and down movement. In the figure three positions of the aforesaid pivoting point 5 are represented, namely the extreme top position I, whereby the knife-supporting beam 1, and therefore also pivoting point 5, are in their highest point; a middle position II, whereby the first pivoting point 5 between the body 1 and the first rod 2 coincide with the first pivoting point 7 between the second rod 3 and the frame of the weaving machine 11; and an extreme bottom position III, whereby the knife-supporting beam 1, and therefore also pivoting point 5, are in their lowest point. What is important in this invention is that in all positions of the knife-supporting beam 1 the pivoting point 5 between the knife-supporting beam 1 and the first rod, the pivoting point 6 between the first 2 and the second rod 3 and the pivoting point 7 between the second rod 3 and the frame of the weaving machine 11 form the angular points of an isosceles triangle, of which the equal sides are formed by distances a between pivoting points 5 and 6, respectively 7 and 6, and that the angle $\alpha_2$ between the first rod 2 and a plane A through pivoting point 6 perpendicular to the direction of movement is always to all intents and purposes equal to the angle $\alpha_1$ between the second rod 3 and a plane B through pivoting point 7 perpendicular to the direction of movement. This condition is achieved when hinge point 8 moves in a straight-line that is perpendicular to the direction of movement in the hinge point 7.

With the movement of the knife-supporting beam 1 from the extreme top position I to the middle position II (see FIG. 3), the first rod 2 and the second rod 3 move toward each other, through which the aforesaid angles $\alpha_1$ and $\alpha_2$ become smaller and pivoting point 8 moves from a first extreme position 8 into the other extreme deflection position 8'. With the movement of the knife-supporting beam 1 from the middle position II to the farthest bottom position III, the first 2 and the second rod 3 move away from each other, through which the aforesaid angles $\alpha_1$ and $\alpha_2$ again become larger and pivoting point 8' goes back to its original position 8.

The pivoting point 8 can also be implemented as a horizontal rectilinear sliding set, through which the aforesaid point 8 moves according to a perfectly rectilinear movement path that is perpendicular to the direction of movement through the point 7. The disadvantage of this is that sliding sets require maintenance. The rectilinear movement of pivoting point 8 is sufficiently approximated to a very small arc, by rotatably connecting rod 4 via a pivoting point 9 to the frame 10. Hinge point 8 will therefore describe an arc of circle with pivoting point 9 as central point. This arc will very closely approach a straight line if the rod 4 is taken sufficiently long and the hinge point 9 lies on the perpendicular bisector of the line part 8, 8'. In a preferred embodiment of this invention the rod mechanism comprises only hinge points, because these require no maintenance.

This device is usually utilized as shed-forming device of a machine of the Jacquard type for the rectilinear guiding of knife-supporting beams. In FIG. 1 and 2 the connecting point is attached in the middle of the knife-supporting beam 1, but this point can also be beyond the middle of the supporting beam 1.

What is claimed is:

1. Device for the rectilinear guiding of a body (1) of a shed-forming device that can be driven in a to and fro movement, characterized in that the device comprises a rod mechanism (2, 3, 4) of which a first (2) and a second rod (3) are rotatably connected to respectively the aforesaid body (1) and a fixed part (11), and that this rod mechanism (2, 3, 4) is provided in order to exert a rectilinear movement on the joint (5) between the body (1) and the first rod (2) in the course of driving the body (1).

2. Device for the rectilinear guiding of a body (1) of a shed-forming device that can be driven in a to and fro movement according to claim 1 characterized in that the joint (5) between the first rod (2) and the body (1) can move in a straight line through the joint (7) between the second rod (3) and the fixed part (11).

3. Device for the rectilinear guiding of a body (1) of a shed-forming device that can be driven in a to and fro movement according to claim 1 characterized in that the first (2) and the second rod (3) are rotatably connected to each other, and that the rod mechanism is so constructed that the joint (6) between the first rod and the second rod (3), the joint (5) between the body (1) and the first rod (2) and the joint (7) between the second rod (3) and the fixed part (11) form the three angular points of an isosceles triangle and that the first (2) and the second rod (3) always form a same angle in relation to the plane perpendicular to the direction of movement.

4. Device for the rectilinear guiding of a body (1) of a shed-forming device that can be driven in a to and fro movement according to claim 1 characterized in that the first rod (2) is rotatably connected in the first joint (5) on this first rod (2) to the body (1), that the second rod (3) is rotatably connected in the first joint (7) on this second rod (3) to the fixed part (11), that the aforesaid first (2) and second rod (3) are rotatably connected to each other in a common second joint (6) so that the distance (a) between the first (5), (7) joints of the first (2) and the second rod (3) and the second joint (6) for both rods (2), (3) is equal, and that means (4) are provided to determine the positions of the rods (2), (3) during the movement of the body (1) so that angle (α2) between the first rod (2) and a plane perpendicular to the direction of movement is always equal to the angle (α1) between the second rod (3) and a plane perpendicular to the direction of movement.

5. Device for the rectilinear guiding of a body (1) of a shed-forming device that can be driven in a to and fro movement according to claim 4 characterized in that the aforesaid first rod (2) extends past the common joint (6) of the first (2) and the second rod (3) and is so guided that a point (8) of the first rod (2) located past the aforesaid common joint (6) can move according to an almost horizontal movement path.

6. Device for the rectilinear guiding of a body (1) of a shed-forming device that can be driven in a to and fro movement according to claim 5 characterized in that the aforesaid point (8) of the first rod (2) and the aforesaid joint (7) between the second rod (3) and the fixed part (11) lie in a same plane extending almost perpendicular to the direction of movement.

7. Device for the rectilinear guiding of a body (1) of a shed-forming device that can be driven in a to and fro movement according to claim 5 characterized in that the first rod (2) is rotatably connected past joint (5) to a third rod (4), which is rotatable in relation to a fixed point (9).

8. Device for the rectilinear guiding of a body (1) of a shed-forming device that can be driven in a to and fro movement according to claim 1 characterized in that the rod mechanism comprises only hinge points.

9. Device for the rectilinear guiding of a body (1) of a shed-forming device that can be driven in a to and fro movement according to claim 1 characterized in that the to and fro movement is an almost vertical movement.

10. Device for the rectilinear guiding of a body (1) of a shed-forming device that can be driven in a to and fro movement according to claim 1 characterized in that the aforesaid shed-forming device is a device disposed on a machine of the Jacquard type.

11. Device for the rectilinear guiding of a body (1) of a shed-forming device that can be driven in a to and fro movement according to claim 1 characterized in that the aforesaid body (1) is a knife-supporting beam.

12. Drive system for knife-supporting beams characterized in that comprising the guiding device according to claim 1.

13. Jacquard machine characterized in that comprising at least one knife-supporting beam working together with guiding device according to claim 1.

* * * * *